United States Patent [19]

Purcell

[11] Patent Number: 4,625,193

[45] Date of Patent: Nov. 25, 1986

[54] MAGNET LEAD ASSEMBLY

[75] Inventor: John R. Purcell, San Diego, Calif.

[73] Assignee: GA Technologies Inc., San Diego, Calif.

[21] Appl. No.: 616,737

[22] Filed: Jun. 4, 1984

[51] Int. Cl.[4] ..... H01F 7/22

[52] U.S. Cl. ..... 335/216; 174/15 CA

[58] Field of Search ..... 335/216; 174/15 CA, 174/15 S, 15 HP; 62/514 R

[56] References Cited

U.S. PATENT DOCUMENTS

| | | | |
|---|---|---|---|
| 3,609,992 | 10/1971 | Cacheux | 62/514 |
| 3,611,746 | 10/1971 | Marsing et al. | 62/514 |
| 3,695,057 | 10/1972 | Moisson-Frankhauser | 174/15 CA |
| 3,708,606 | 1/1973 | Shattes et al. | 174/15 C |
| 3,900,699 | 8/1975 | Penczynski et al. | 174/15 CA |
| 3,959,576 | 5/1976 | Penczynski | 174/15 BH |
| 4,369,636 | 1/1983 | Purcell et al. | 335/216 X |
| 4,394,634 | 7/1983 | Vansant | 335/216 |
| 4,447,670 | 5/1984 | Eckels | 174/15 CA |

*Primary Examiner*—George Harris

*Attorney, Agent, or Firm*—Fitch, Even, Tabin & Flannery

[57] ABSTRACT

A lead assembly provides an electrical connection between a magnet coil maintained at low temperature in a boiling liquid bath within a closed container and a power supply terminal maintained at a higher temperature outside of the container. The assembly includes a length of cable which is superconducting at the low temperature and normally conducting at higher temperatures and is disposed within a tube which communicates with the interior of the container so as to vent vapor from the boiling liquid bath out of the container through the tube along the cable to cool the cable to superconducting temperature near the magnet coil. The cable is preferably formed of a plurality of loosely twisted copper-stabilized superconducting strands.

10 Claims, 3 Drawing Figures

MAGNET LEAD ASSEMBLY

BACKGROUND OF THE INVENTION

The present invention relates to a magnet lead for connecting a power supply to a superconducting magnet coil.

A superconducting magnet typically comprises a coil of relatively fine superconducting wire. To enable the superconducting wire to function as a superconductor, the coil must be maintained at an extremely low temperature below the transition point of the superconductive material. It is well known to locate a superconducting magnet coil in a bath of liquid helium within a container to maintain it at an acceptable operating temperature.

The magnet coil is typically connected to a power supply by a pair of leads. The power supply is typically at room temperature, and accordingly heat is typically conducted to the magnet coil through the leads. Also, heat generated in the leads due to ohmic losses is typically transferred to the coil.

It has been proposed to employ a lead comprising a normal portion near the power supply and a superconducting portion near the magnet, spliced end to end. However, joining the normal conductor to the superconductor complicates assembly of the lead. Also, during operation the normal portion must be cooled to an extremely low temperature so as to prevent it from transferring heat to the superconducting portion and raising the temperature thereof beyond its superconducting range. It is difficult to provide such cooling efficiently.

SUMMARY OF THE INVENTION

In accordance with the present invention, a lead assembly for a magnet coil includes a length of cable which is superconducting at very low temperatures and normally conducting at higher temperatures, and means for venting vapor from a vessel containing the magnet coil immersed in a boiling liquid bath, the vapor being vented along the cable to cool a portion of the cable near the magnet coil to superconducting temperature. To enable efficient heat transfer from the cable to the vapor, the cable is preferably formed of a plurality of loosely-twisted strands.

The means for venting vapor from the container along the cable comprises a tube having an interior channel communicating with the interior of the vessel. The tube preferably has an outlet end disposed outside of the container and an inlet end disposed near the surface of the helium bath.

Accordingly, it is a general object of the present invention to provide a magnet lead for providing electrical power to a superconducting magnet coil while transferring relatively little heat to the superconducting magnet coil.

It is a further object of the present invention to provide a magnet lead assembly employing a copper-stabilized superconducting conductor which may function as a superconductor along one portion of its length and function as a normal conductor along another portion of its length.

DETAILED DESCRIPTION OF PREFERRED EMBODIMENTS

The present invention is generally embodied in a magnet lead assembly for providing an electrical connection between a superconducting magnet coil 10 and a power supply terminal 11.

Figure 1:
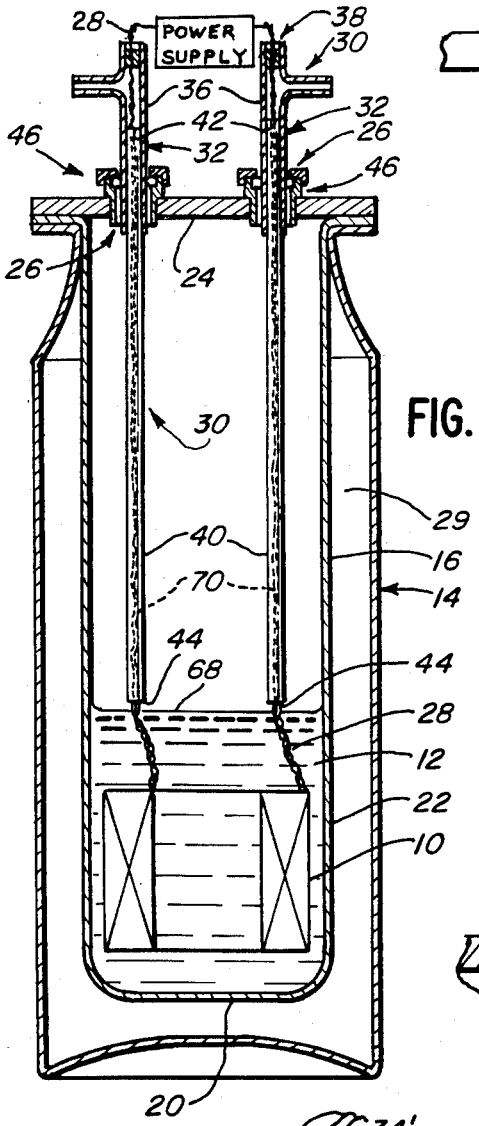
FIG. 1 is a partly diagrammatic sectional view of a superconducting magnet assembly including a magnet lead assembly in accordance with the present invention.
Figure 2:
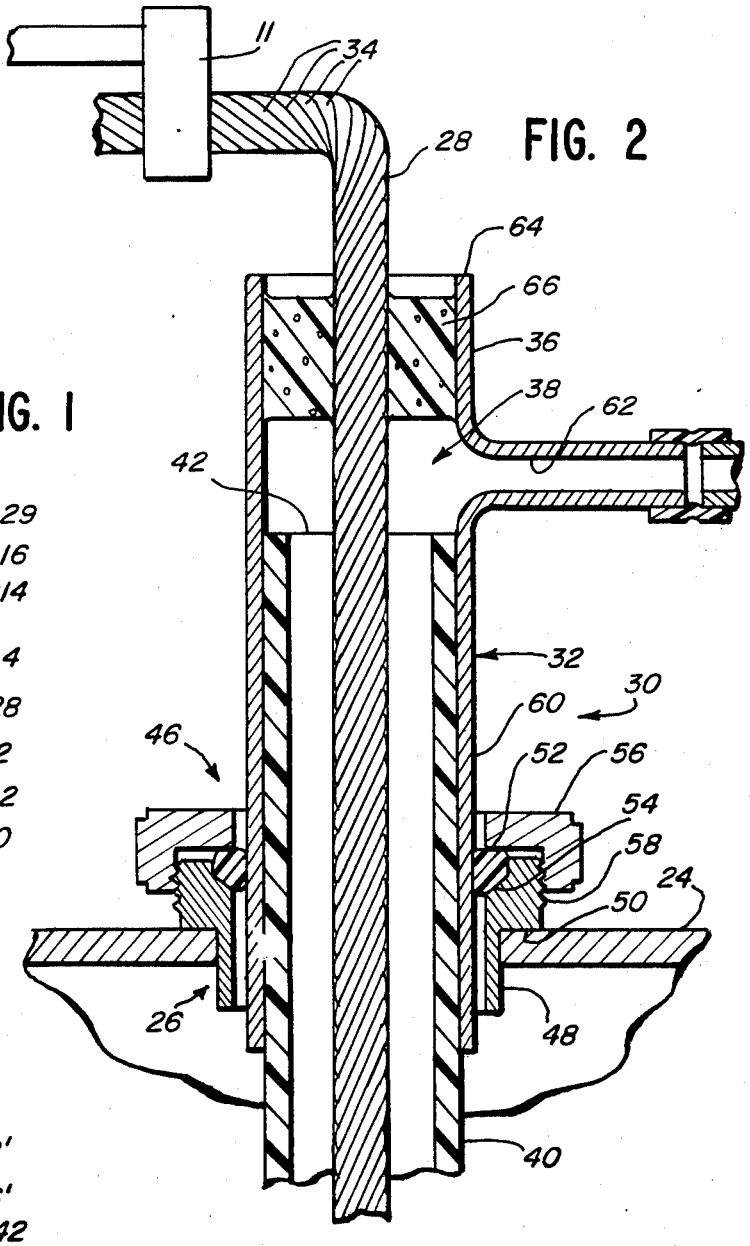
FIG. 2 is a partial enlarged sectional view of a magnet lead assembly in accordance with the present invention.

Referring particularly to the embodiment illustrated in FIGS. 1 and 2, there is shown a superconducting magnet coil 10 immersed in a bath 12 of low temperature liquid helium disposed within a container 14. The magnet 10 comprises a length of relatively thin wire or filament wound in a large number of turns and supported on a core. The illustrated container 14 is a Dewar vessel which includes an inner wall 16 defining an open-topped interior, an outer wall 18 disposed outwardly of the inner wall 16 at the bottom 20 and about the periphery 22 thereof, and a solid lid 24 extending across the open top and having a pair of openings 26 therein to accommodate a pair of leads 28. An evacuated space 29 is provided between the inner and outer walls to prevent conductive heat transfer therebetween. The helium bath 12 is contained within the interior defined by the inner wall 16.

The evacuated space or vacuum 29 acts as a barrier to thermal conduction into the bottom and periphery of the bath 12. Resistance to heat transfer from above the bath is provided by the helium vapor rather than a vacuum, the vapor being relatively stagnant and hence warmer at the top and cooler at the bottom, providing effective insulation.

Generally, during operation of the magnet 10 the bath 12 is maintained at its boiling temperature. Heat transferred to the helium bath 12 is removed therefrom by the boiling of the liquid, changing state to vapor, which is itself removed from the vessel 14. More liquid helium is added to the bath 12 periodically to replace that lost by vaporization. It is desirable to minimize the transfer of heat to the bath 12 through the leads 28 in order to minimize the quantity of liquid helium which must be replaced.

In accordance with the present invention, a lead assembly 30 is provided which includes a length of cable or lead 28 which is superconducting at the very low temperatures of the bath 12 and normally conducting at the higher temperatures in the terminal 11, and means 32 for venting vapor from the container 14 along the cable 28 to cool a portion of the cable 28 near the magnet coil 10 to superconducting temperature. To enable efficient heat transfer from the cable 28 to the vented helium vapor, the cable is preferably formed of a plurality of loosely-twisted strands 34.

To enable the cable to be superconducting at very low temperatures and normally conducting at higher temperatures, each of the strands 34 herein comprises a niobium-titanium filament having a layer of copper thereon. The strands 34 may be formed by a coextrusion process. The number and composition of strands 34 enable the cable 28 to carry the desired current for operation of the magnet either as a normal conductor or as a superconductor. The niobium-titanium filaments primarily carry the current through portions maintained at very low temperature, and the copper primarily carries the current through portions at higher temperatures.

In each lead assembly 30, the preferred means for venting vapor from the container along the lead or cable 28 comprises a conduit 36 mounted on the vessel lid 24 and having an interior channel 38 communicating with the interior of the vessel 14, and an insulating tube 40 having an outlet end 42 disposed within the conduit and having an inlet end 44 disposed near the surface of the helium bath 12. Each tubular insulator 40 is preferably dimensioned for an interference fit in its associated conduit 36 so that it is maintained therein by friction.

Each conduit 36 herein is supported on the lid 24 of the Dewar vessel 14 by an adjustable gripping assembly 46 comprising a sleeve 48 extending through the lead opening 26 in the lid 24 outwardly of the conduit 36 and having an external support shoulder 50 thereon; an O-ring 52 engaging a frustoconical inner surface 54 on the sleeve 48; and a rotatable collar 56 which is internally threaded for engagement with an external thread 58 on the sleeve 48 and which bears against the O-ring 52 so that tightening of the collar 56 urges the O-ring 52 downwardly and inwardly on the frustoconical surface for gripping engagement with the outer surface 60 of the conduit. The O-ring 52 additionally provides a seal to prevent escape of helium vapor around the exterior of the conduit.

During operation of the magnet 10, the helium bath 12 generally boils, producing helium vapor which travels into the inlet ends 44 of the insulating tubes 40, through the tubes 40 into the conduits 36, and out of the conduits 36 through exhaust ports 62 into a condenser or other suitable receptacle (not shown). To restrict transfer of heat along the insulating tubes 40, they are preferably made of a material having good thermal insulating properties. The insulating tubes 40 also preferably have good electrical insulating properties to prevent arcing between the cables and their associated conduits, which may be grounded. The tubes 40 herein are preferably made of polytetrafluoroethylene.

The cable 28 extends out of the upper end 64 of the conduit 36 adjacent the exhaust port 62 and is connected to a power supply terminal 11 adjacent thereto. To provide electrical insulation between the cable 28 and the upper end 64 of the conduit 36 at the exit of the cable 28, and to prevent escape of vapor from the conduit 36 to the atmosphere, an epoxy insulating plug 66 seals the upper end of the conduit about the cable.

To maximize cooling of the cable 28, it is desirable for the vapor entering the inlet end 44 of the insulating tube 40 to be at the lowest possible temperature. To this end, means are provided to support the tube 40 so that it has its inlet end 44 a short distance above the surface 68 of the bath 12. Because the vapor above the bath surface 68 is stratified, with higher temperature vapor being located above the lower temperature vapor due to differing densities, this provides that the vapor entering the inlet end 44 of the tube 40 is the coolest vapor in the container 14.

The helium vapor entering the lower end 44 of the insulating tube 40 cools the lower portion 70 of the cable 28 to a sufficiently low temperature that this portion 70 of the cable 28 functions as a superconductor. The vapor is warmed as it travels upwardly along the cable 28 through the loosely wound strands, and at some point along the length of the cable 28, the temperature of the vapor becomes too high to cool the cable 28 sufficiently to enable superconducting operation. The portion of the cable 28 above this point functions as a normal conductor. This point is referred to herein as the transition point of the lead. The temperature at which the filaments become superconducting is referred to herein as the critical temperature.

Superconducting operation of the lower portion 70 of the lead 28 reduces ohmic losses in the lead 28, and thereby contributes to the efficiency of the system, both in that it reduces the amount of power required to supply a desired level of current to the magnet 10, and in that it reduces the quantity of heat produced by the current due to ohmic losses which must be prevented from heating the interior of the Dewar vessel 14.

The system is self-regulating in that if the transition point moves lower along the lead 28, for example, due to insufficient cooling of the cable, the helium 12 boils at a higher rate due to increased heat transfer to the helium bath, and gas or vapor flow along the lead 28 increases, thus cooling the lead 28 at a higher rate and moving the transition point upwardly. If, on the other hand, the transition point moves to a relatively high point on the lead 28, the helium will then boil at a lower rate and the flow of the vapor coolant will decrease, lowering the transition point.

Another important feature of the lead assembly 30 described herein is that it is more efficient than a system wherein a normal conductor and a superconducting conductor are joined at some point to provide a path for electrical current from a power supply to the magnet, because in such a system, the superconducting portion of the lead must be cooled to the critical temperature and maintained at or below that temperature, which requires that the normal conductor also be maintained at or below that temperature with no resultant benefit in the conductivity of the normal conductor. In the lead assembly 30 of the present invention, every portion of the lead or cable 28 which is cooled below the critical temperature becomes superconducting, with the resultant benefits in efficiency described above.

Figure 3:
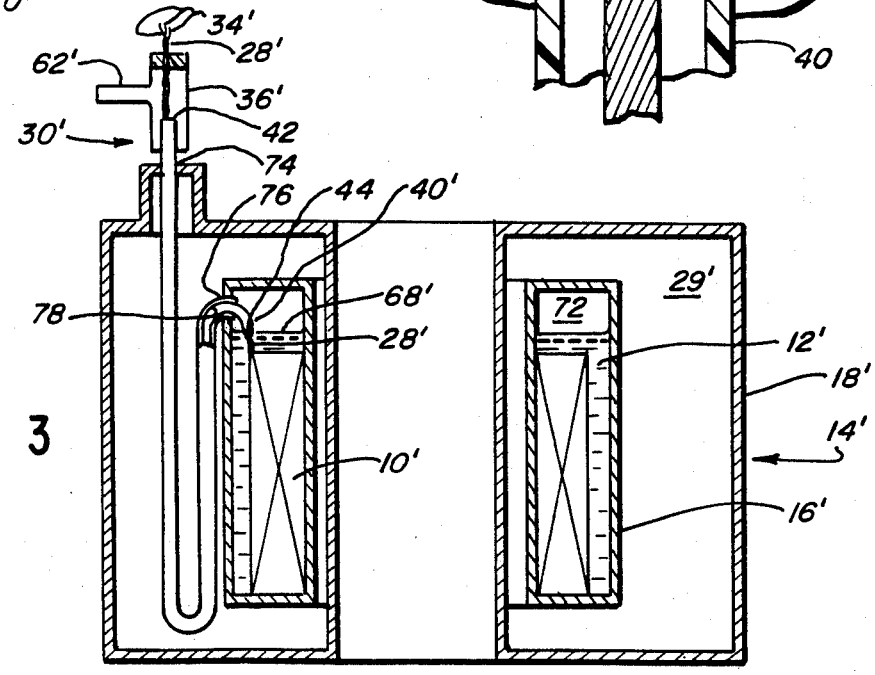
FIG. 3 is a diagrammatic sectional view of a superconducting magnet assembly including a magnet lead assembly in accordance with an alternative embodiment of the present invention.

The embodiment of the invention illustrated in FIG. 3 is for use with a "closed" Dewar vessel 14' which comprises an inner wall 16' surrounded on all sides by a vacuum 29' contained within an outer wall 18'. In this embodiment of the invention, the inner wall 16' defines an annular interior space containing a magnet 10' and helium bath 12'. The outer wall 18' similarly defines an annular space for the vacuum. Only a relatively small plenum 72 is provided above the helium bath 12' for helium vapor, because the helium vapor does not perform an insulating function as it does in the "open" Dewar vessel 14 described above and illustrated in FIG. 1.

In the embodiment illustrated in FIG. 3, a lead 28' extends through an opening 74 in the outer wall 18', through the vacuum space 29' and through an opening 76 in the inner wall 16' to communicate with the interior space defined by the inner wall 16'. Only one lead assembly 30' is illustrated in FIG. 3, but a second identical lead is also provided. As in the embodiment illustrated in FIGS. 1 and 2 and described above, the lead assembly 30' includes a lead or cable 28' which comprises a plurality of loosely-twisted strands 34' formed of copper-stabilized superconductors. Also as described above, the lead assembly 30' in FIG. 3 includes a conduit 36' supported outside of the vessel 14' having an exhaust port 62' therein communicating with a suitable condenser or other receptacle for the helium vapor.

The embodiment illustrated in FIG. 3 differs from the embodiment illustrated in FIGS. 1 and 2 in that the cable 28′ is enclosed between the inner wall 16′ and the outer wall 18′ of the closed Dewar vessel 14′ by an inner insulating tube 40′ and an outer metal tube 78. The outer metal tube 78 is preferably made of stainless steel, as are the inner and outer walls 16′ and 18′ of the Dewar vessel 14′, so that satisfactory seals to maintain the vacuum may be readily provided by welding the tube 78 to the vessel walls at the openings 26′ and 76.

As in the embodiment described above, the insulating tube 40′ is preferably made of polytetrafluoroethylene, which exhibits satisfactory strength properties under cryogenic conditions. The tube has its inlet end 44′ disposed just above the bath surface 68′, and has its outlet end 42′ disposed within the conduit 36′ outside of the vessel.

A relatively long length of cable 28′ should be provided between the inner wall 16′ and outer wall 18′ of the Dewar vessel in order to provide a relatively long path for thermal conduction. To this end, the cable 28′ and surrounding tubes 40′ and 78 in the embodiment illustrated in FIG. 3 extend downwardly below the bottom 20′ of the inner wall 16′ and double back up to the opening 76 near the top of the inner wall. As in the embodiment illustrated in FIGS. 1 and 2, the cable 28′ is connected at one end to the wire which forms the magnet coil 10′ and at its opposite end to a power supply terminal, and the connection to the magnet 10′ may be made by soldering the end of the cable 28′ to the end of the magnet wire.

From the foregoing, it will be appreciated that the present invention provide a novel and improved lead assembly for a superconducting magnet. While preferred embodiments of the invention have been described in detail, there is no intent to limit the invention to these or any other particular embodiments.

What is claimed is:

1. A lead assembly for providing an electrical connection between a first electrical device maintained at low temperature in a boiling liquid bath within a closed container and a second electrical device maintained at a higher temperature outside of said container, the lead assembly comprising:

a tube having an inlet end and an outlet end;

a length of cable which is superconducting at said low temperature and normally conducting at said higher temperature, extending through said tube and protruding therefrom at said inlet end;

means for positioning said tube with its inlet end within said container close to said bath and with its outlet end outside of said container so that vapor is vented from said boiling liquid bath through said tube to cool said length of cable near said inlet end so that said cable is superconducting near said inlet end.

2. A lead assembly in accordance with claim 1 wherein said cable comprises a plurality of stabilized superconducting strands.

3. A lead assembly in accordance with claim 2 wherein said strands are loosely twisted so as to enable flow of said vapor therebetween.

4. A lead assembly in accordance with claim 2 wherein each of said strands comprises a niobium-titanium filament disposed within a layer of copper.

5. Apparatus for producing a magnetic field comprising:

an insulating vessel defining an enclosed interior;

a bath of liquid helium contained within said vessel;

a magnet coil immersed in said bath of liquid helium;

a power supply for providing electrical current to said magnet coil, said power supply having a pair of terminals; and a pair of lead assemblies for providing electrical connections between said power supply and said magnet coil, each said lead assembly comprising a tube defining an interior channel communicating with the interior of said container so as to permit flow of vapor from said container into said channel, and a length of copper-stabilized superconducting cable extending from the magnet coil through the tube to one of said power supply terminals.

6. Apparatus in accordance with claim 5 further wherein said tube comprises an elongated tubular insulator extending about said cable, the tubular insulator having an inlet end positioned within the insulating vessel near the surface of the bath of liquid helium and an outlet end disposed outside of the insulating vessel.

7. Apparatus in accordance with claim 6 wherein said tube further comprises a conduit positioned outside of said vessel and having the outlet end of the tubular insulator disposed therein.

8. Apparatus in accordance with claim 6 wherein said insulating vessel is a Dewar vessel comprising:

an inner wall defining an open-top interior;

an outer wall enclosing said inner wall about its bottom and sides and sealed thereto so as to define an enclosed vacuum space about the bottom and sides of the inner wall between the two walls; and a lid having at least one opening therein for said lead assemblies.

9. Apparatus in accordance with claim 6 wherein said insulating vessel comprises a Dewar vessel having an inner wall defining a closed annular interior space and an outer wall surrounding said inner wall on all sides and defining an annular vacuum space between said inner wall and said outer wall, each of said inner and outer walls having at least one opening therein to accommodate said lead assemblies.

10. Apparatus in accordance with claim 6 wherein said tube further comprises a length of metal tubing disposed generally coaxially about said tubular insulator and extending through said openings in said inner and outer walls, said metal tubing being welded to said inner and outer walls about said openings to provide seals about said openings.

* * * * *

UNITED STATES PATENT AND TRADEMARK OFFICE

CERTIFICATE OF CORRECTION

PATENT NO. : 4,625,193

DATED : November 25, 1986

INVENTOR(S) : John R. Purcell

It is certified that error appears in the above-identified patent and that said Letters Patent is hereby corrected as shown below:

Column 3, line 1, change "temperature" to --temperatures--.

Column 6, line 27, delete "further".

Column 6, line 28, insert --each-- between "wherein" and "said".

Signed and Sealed this

Twenty-fifth Day of August, 1987

*Attest:*

DONALD J. QUIGG

*Attesting Officer*

*Commissioner of Patents and Trademarks*